US005090316A

United States Patent [19]

Rodi et al.

[11] Patent Number: 5,090,316

[45] Date of Patent: Feb. 25, 1992

[54] METHOD AND DEVICE FOR DETERMINING DAMPENING-MEDIUM FEED IN AN OFFSET PRINTING MACHINE

[75] Inventors: Anton Rodi, Leimen; Hermann Kraft, Dossenheim, both of Fed. Rep. of Germany

[73] Assignee: Heidelberger Druckmaschinen AG, Heidelberg, Fed. Rep. of Germany

[21] Appl. No.: 511,057

[22] Filed: Apr. 19, 1990

[30] Foreign Application Priority Data

Apr. 19, 1989 [IB] Int'l Pat. Institute ..... 3912811

[51] Int. Cl.[5] ..... B41F 7/24

[52] U.S. Cl. ..... 101/148; 101/451; 101/DIG. 45; 101/484

[58] Field of Search ..... 101/DIG. 45, 148, 451, 101/484

[56] References Cited

U.S. PATENT DOCUMENTS

| | | | |
|---|---|---|---|
| 3,433,155 | 3/1969 | Norton | 101/148 |
| 3,744,414 | 7/1973 | Krochert | 101/148 |
| 3,960,451 | 6/1976 | Wirz et al. | 101/350 X |
| 4,089,264 | 5/1978 | Jeschke et al. | 101/365 |
| 4,446,814 | 5/1984 | Abeudroth et al. | 118/694 |
| 4,480,542 | 11/1984 | Jeschke | 101/DIG. 45 |
| 4,485,737 | 12/1984 | Jeschke | 101/148 |
| 4,530,285 | 7/1985 | Fischer | 101/DIG. 45 |
| 4,972,774 | 11/1990 | MacPhee | 101/DIG. 45 |

FOREIGN PATENT DOCUMENTS

| | | | |
|---|---|---|---|
| 863048 | 2/1971 | Canada . | |
| 2214721 | 6/1973 | Fed. Rep. of Germany . | |
| 2947791 | 6/1981 | Fed. Rep. of Germany . | |
| 3211157 | 10/1983 | Fed. Rep. of Germany . | |
| 3220701 | 12/1983 | Fed. Rep. of Germany . | |
| 0163572 | 10/1982 | Japan | 101/148 |
| 0116153 | 7/1983 | Japan | 101/148 |
| 0135158 | 8/1984 | Japan | 101/148 |
| 63-16224 | 3/1988 | Japan . | |
| 1393856 | 5/1975 | United Kingdom . | |

OTHER PUBLICATIONS

FOGRA-MITT No. 53, Jul. 1967, p. 25, "Dahlgren-Feuchtwerk".

German Publication: Zusammenwirken von Druckfarbe und Wasser im Offsetdruck, pp. 45-59: Wirz et al.

Publication, "Hauptdruckverfahren", Exhibit A.

Publication, "Bruckmann's Handbuck der Drucktechnik", Bruckmann, München, 1976, Exhibit B.

Great Britain, "Peutech Press", Landow, pp. 206-227; article, Advances in Printing Science and Technology.

*Primary Examiner*—Clifford D. Crowder

*Attorney, Agent, or Firm*—Herbert L. Lerner; Laurence A. Greenberg

[57] ABSTRACT

A method of determining dampening-medium feed in an offset printing machine includes inking a printing plate of the printing machine so that tinting of areas of the printing plate which are normally ink-free during a production-run process occurs, and feeding a defined quantity of dampening medium and increasing dampening-medium feed, respectively, while detecting a process of ink taking from the tinted areas, which is applicable as a measurement for the dampening-medium feed being adjusted; and a device for performing the method.

22 Claims, 4 Drawing Sheets

METHOD AND DEVICE FOR DETERMINING DAMPENING-MEDIUM FEED IN AN OFFSET PRINTING MACHINE

The invention relates to a method and device for determining the dampening-medium feed in an offset printing machine.

A method of determining dampening-medium feed in an offset printing machine has become known heretofore in printing-technology practice wherein the printer manually adjusts a dipping or water-pan roller and a metering roller with respect to one another so that, initially, only a relatively small compressive contact force exists between these rollers.

A quantity of dampening medium conveyed by the dipping or water-pan roller is transferred via the metering roller and a dampening-medium applicator roller to the surface of an offset-printing plate clamped to a plate cylinder. Because of the relatively slight contact pressure, the conveyance or advancement of dampening medium is relatively large. This is also optically visible; the dipping or water-pan roller, which is formed of rubber, acquires a shiny film of dampening medium. Starting from this pre-adjustment, the printer then performs the basic adjustment for the quantity of dampening medium, in that he or she adjusts the dipping or water-pan roller and the metering roller relative to one another, while increasing the contact pressure therebetween so that, as the dipping or water-pan roller is being observed, a uniform film is formed on the metering roller. The aforedescribed shiny layer of dampening medium thereby assumes a mat appearance. Due to the aforedescribed procedure, a largely parallel positioning of the dipping or immersion roller and the metering roller is achieved which is dependent upon the individual capabilities of the printer. After this adjustment is achieved, under certain circumstances, problems may nevertheless arise during the production run, if there is a non-uniform distribution of ink over the width of the printing format. Thus, on the side where less dampening medium is required, an excess of dampening medium may form, which might possibly result in the build-up of an unstable emulsion. On the other side, if there is an adequate feed dampening medium, an inking of surfaces which are normally ink-free in a production run can occur. This inking is called "tinting" or "emulsifying".

It is accordingly an object of the invention to provide a method and device for determining dampening-medium feed in an offset printing machine wherein the requirement or demand for dampening medium is taken into account over the width of a format and printed-subject area, respectively, in dependence upon the printed-subject area, so that problem-free printing is assured.

With the foregoing and other objects in view, there is provided, in accordance with the invention, a method of determining dampening-medium feed in an offset printing machine, which comprises inking a printing plate of the printing machine so that tinting of areas of the printing plate which are normally ink-free during a production-run process occurs, and feeding a defined quantity of dampening medium and increasing dampening-medium feed, respectively, while detecting a process of ink taking from the tinted areas, which is applicable as a measurement for the dampening-medium feed being adjusted.

Accordingly, the damp film on the rollers of the dampening unit is no longer observed when determining the setting or adjustment values for the dampening medium (as is the case in the present state of the Art), but rather, the transitional behavior of an inked printing plate is observed as dampening medium is applied thereto. In this regard, the offset printing plate is initially "filled", preferably by the feeding of a defined quantity of ink. This is an inking of the printing plate, whereby surfaces which are normally ink-free in a production-run process also receive ink. This filling process is carried out without any or with only a slight dampening-medium feed. It is followed by a defined dampening-medium feed and an increase in dampening-medium feed to a defined value, respectively, while detecting or recording the resultant process of ink taking or reduction from the previously tinted surfaces. Depending upon how large the fed quantity of dampening medium is, and on its distribution over the width of the printing format, a "free running" of the offset printing plate will adjust itself, that is, the tinted surfaces will lose the ink again in dependence upon the dampening-medium feed. The manner and nature of this ink taking or reduction process represents a measurement for the dampening-medium feed to be adjusted. If, for example, in the case of a dampening-medium feed which is inappropriate for the printed subject area, only one side margin of the offset printing plate runs free, while tinted areas are retained on the other side, this is an indication that the adjustment in dampening medium is not yet correct for the printing process about to be undertaken. However, at the same time, there is a clear indication of the direction to be taken in order to achieve optimal adjustment of the dampening medium, because the one-sided lack of free running of the printing plate denotes that the quantity of dampening medium which is fed must be increased on this side. The recording or detection of the ink taking or reduction process with regard to intensity and time affords detailed conclusions concerning the dampening-medium feed, so that an optimal dampening-medium adjustment, adequate to the printed subject area and to the ink feed, can be found in a rapid and simple manner, which is accordingly based on consumption-dependent factors so that in the subsequent production run, there is no danger of tinting and the formation of an unstable emulsion which prevents the application of ink, respectively, which would otherwise result in spoilage or waste formation.

In order to be able to perform a dampening-medium feed appropriate to the requirements in the case of printing plates with unequal distribution of ink over the width of the printing format, there is provided, in accordance with another mode of the method invention, feeding the dampening medium controlled in dependence upon the printed subject area, over the width of the format and the width of the printed-subject area, respectively.

Preferably, in the case of free-running of the offset printing plate, the method is such that the tinting areas become substantially uniformly ink-free over the width of the format. This means that, during the free-running process, the dampening-medium feed over the width of the printing format is adjusted so that all of the tinted surfaces are subject to uniform ink reduction or taking. A result thereof is that the desired dampening-medium adjustment is achieved at the end o the free-running process.

During implementation of the method according to the invention, the recording or detection of the ink reduction or taking is performed by the printer, i.e. by visual observation. In this case, the individual capabilities of the printer play an important role. But it is also possible, as an alternative mode of the invention for the recording or detection of the ink reduction to be performed by means of optical sensors. Accordingly, an automatic adjustment of the dampening-medium feed is possible, if the data detected by the sensors are used to adjust the dampening unit.

In accordance with a further mode according to the invention, the method includes monitoring the ink taking in a peripheral zone of the printing plate which is clamped to an impression cylinder of the printing machine. In particular, this monitoring of the ink taking or reduction occurs at a location which is arranged beforehand at the two marginal printed subject areas, taking into account the direction of rotation of the plate cylinder. Particularly good and significant results are achieved if the control or monitoring of the ink taking or reduction is performed in an area between the start of the printing plate and the start of the printed subject area. This intermediate area is predestined especially for the measurement because for each revolution, the dampening medium applicator roller makes contact thereat after passing the longitudinal groove (channel) of the plate cylinder which is used for attaching the printing plate, so that changes of parameter can be recognized thereat at the earliest opportunity. This scanning location, which is of importance for the invention, is also the area from which any smearing which might take place will originate. This is understood to mean the appearance of ink during the printing process on areas which are of themselves ink-free.

In accordance with an additional mode, the method according to the invention includes monitoring the ink taking periodically.

In accordance with a more specific mode of the method according to the invention, the periodic monitoring of the ink taking is with each revolution of a plate cylinder on which the printing plate is clamped.

The method according to the invention distinguishes over the prior art by the characteristic thereof that the adjustment of dampening medium is performed before the actual printing process. The filling and free running of the printing plate can accordingly take place without supplying any printing medium (e.g. paper), so that the production of spoilage or waste is restricted to the greatest possible extent.

In accordance with yet another mode of the method according to the invention, the quantity of dampening-medium fed, as well as the distribution thereof over the width of the printing format, results from at least one of the steps of adjusting the rotational speed of a dipping roller of a dampening unit, adjusting contact pressure between the dipping roller and a metering roller of the dampening unit, and adjusting a relative inclination of the dipping roller and the metering roller to one another. Dependent upon the rotational speed of the dipping roller, the quantity of dampening medium to be conveyed is metered by means of the differential speed of the rollers. The greater the contact pressure between the aforementioned rollers, the thinner is the film of dampening medium which is conveyed. The distribution of dampening medium can be varied over the width of the printing format by means of the adjustment of the dipping roller and the metering roller at an inclination to one another.

Furthermore, with the method according to the invention, the thickness of the layer of dampening medium can additionally be determined by means of the sensors. Accordingly, the sensors fulfill a double function, by recording or detecting the tinting of areas which normally are ink-free for adjusting the dampening-medium feed before and at the start of the printing process, respectively, and also, for example, in a time-sharing process, by determining the dampening-medium feed with respect to the thickness of the layer.

In accordance with yet a further mode of the method invention, the sensing of the tinted condition is not limited to the period before the production run process, but rather, can also take place during the production run phase, so that appropriate interventions can be made into the dampening-medium feed during this period as well. The danger of smearing is thereby considerably reduced. Moreover, the double function of the sensors can also be used during the production run process, that is, the sensors can continuously determine the thickness of the layer of dampening medium and, for example, can accordingly represent the actual value transmitter for a control circuit for dampening medium.

In accordance with yet an additional aspect of the invention, there is provided, a method of determining dampening-medium feed in an offset printing machine, wherein a quantity of dampening medium is applied to a printing plate, which comprises feeding ink over the width of a printing format in dependence upon a printed-subject area of the printing plate so that areas which are normally ink-free in a production-run process performed in the printing machine receive ink as tinting, and detecting the tinting process and applying it as a measurement for the dampening-medium feed being adjusted. This mode of the method represents a variation wherein, in this instance, it is not the free-running of the printing plate with ink which is taken as a measurement for the dampening-medium feed to be adjusted, but rather the filling process. This filling process is dependent upon the quantity of dampening medium which is simultaneously available. If this is not adjusted to the printed subject area of the installed printing plate, then, for example, a non-uniform inking or ink feed will ensue, which provides conclusions or inferences with regard to the proposed correction of the dampening-medium feed. Both the manner and nature of the feed and the time required therefor represent essential information.

In accordance with an alternate aspect of the invention, the method of determining dampening-medium feed in an offset printing machine, wherein a quantity of dampening medium is applied to a printing plate, comprises feeding ink in dependence upon a printed-subject area of the printing plate over the width of a printing format, thereafter, reducing the quantity of dampening medium so that areas which are normally ink-free in a production-run process performed in the printing machine receive ink as tinting, and detecting the tinting process and applying it as a measurement for the dampening-medium feed being adjusted. In contrast with the two aforedescribed method variations, a third mode of the method invention is thus provided wherein, due to the reduction in the dampening-medium feed, a filling of the offset printing plate with ink occurs. The course of the tinting process introduced in this manner represents the measurement for the dampening-medium feed to be adjusted, as described elsewhere hereinbefore.

In accordance with another aspect of the invention, there is provided a device for determining dampening-medium feed in an offset printing machine, comprising a sensor device for optically scanning a surface area of a printing plate clamped to a plate cylinder and transmitting an output signal influencing the feed of a quantity of dampening medium to a roller assembly of a dampening unit including a dipping roller and a metering roller cooperatively in contact with one another, the sensor device comprising at least two sensors disposed at a spaced distance from one another in a direction of the width of a printing format for monitoring tinting of areas of the printing plate which are normally ink-free in a production-run process in the printing machine, and a positioning device for adjusting coplanar axes of the dipping roller and the metering roller at an inclination to one another. Due to the configuration of the sensors in accordance with the invention, processes developing asymmetrically over the width of the printing format are immediately recognizable. Because of the appropriate inclined positioning of the dipping roller and the metering roller to one another, such processes are counteracted.

From German Published Non-Prosecuted Application (DE-OS) 31 05 020, a device for applying fluid has become known heretofore, wherein a fluid wedge forming between an arrangement of rollers is scanned by sensors. In German Published Prosecuted Application (DE-AS) 24 12 234, a device for measuring the thickness of a layer of dampening medium is described wherein a sensor determines the quantity of dampening medium on the printing plate, and controls the rotational speed of the dipping roller in relation thereto. German Published Non-Prosecuted Application (DE-OS) 15 36 450 relates to a device for applying a dampening liquid wherein, due to an adjustment of a roller bearing, the axes of cooperating rollers can be adjusted at an inclination to one another. Japanese patent publication 63-162243 relates to a determination of the thickness of a layer of dampening medium on the surface of a printing plate by means of a sensor, which controls the rotational speed of the dipping roller.

Preferably, at each end region of the dipping roller and the metering roller, respectively, a positioning or adjusting device is provided with an electrical positioning or adjusting drive. Each positioning or adjusting drive has a positioning probe or feeler connected to an electrical control device, which may be, though not necessarily, a microprocessor, which triggers the appertaining positioning or adjusting drive, and to which the sensors are connected. Potentiometers are used as the positioning probes. The arrangement is of such construction that the sensors preferably monitor the area between the start of the printing plate and the start of the printed subject area, because variations in the process parameters can be recognized thereat at the earliest opportunity.

In accordance with another feature of the invention, a series of optical sensors is provided, with several (even more than two) sensors, preferably spaced at uniform distances from one another, and monitoring the inking condition of the printing plate. This permits more-or-less zone-by-zone monitoring of the outer peripheral surface area of the offset printing plate.

In accordance with another aspect of the invention, there is provided a method of operating a device for determining dampening-medium feed in an offset printing machine having an inking unit and a sensor device for optically scanning a surface of a printing plate and for transmitting an output signal influencing a quantity of dampening medium being fed to a roller assembly of a dampening unit, which comprises controlling the inking unit so that inking of the printing plate includes tinting areas with ink which are normally ink-free in a production-run process, and subsequently having the roller assembly of the dampening unit feed dampening medium under control of the sensor device and taking into account a process of ink taking from the tinted areas.

In accordance with a further aspect of the invention, there is provided a method of operating a device for determining dampening-medium feed in an offset printing machine having a printing plate, a sensor device for optically scanning the printing plate, an inking unit for inking the printing plate, and a dampening unit for applying dampening medium to the printing plate, which comprises controlling the inking unit so as to ink the printing plate, with respect to a printed-subject area, over the width of a printing format, so that areas of the printing plate which are normally ink-free in a production-run process receive ink as tinting, and detecting the tinting process with the sensor device and adjusting dampening-medium feed by means of the dampening unit in relation thereto.

In accordance with a concomitant aspect of the invention, there is provided a method of operating a device for determining dampening-medium feed in an offset printing machine having a printing plate, a sensor device for optically scanning the printing plate, an inking unit for inking the printing plate, and a dampening unit for applying dampening medium to the printing plate, which comprises inking over the width of a printing format with the inking unit, in dependence upon a printed-subject area, and then reducing the quantity of dampening medium with a control device of the dampening unit so that areas which are normally ink-free receive ink as tinting, and detecting the tinting process with the sensor device and adjusting the feed of dampening medium with the dampening unit in relation thereto.

Other features which are considered as characteristic for the invention are set forth in the appended claims.

Although the invention is illustrated and described herein as embodied in a method and device for determining dampening-medium feed in an offset-printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
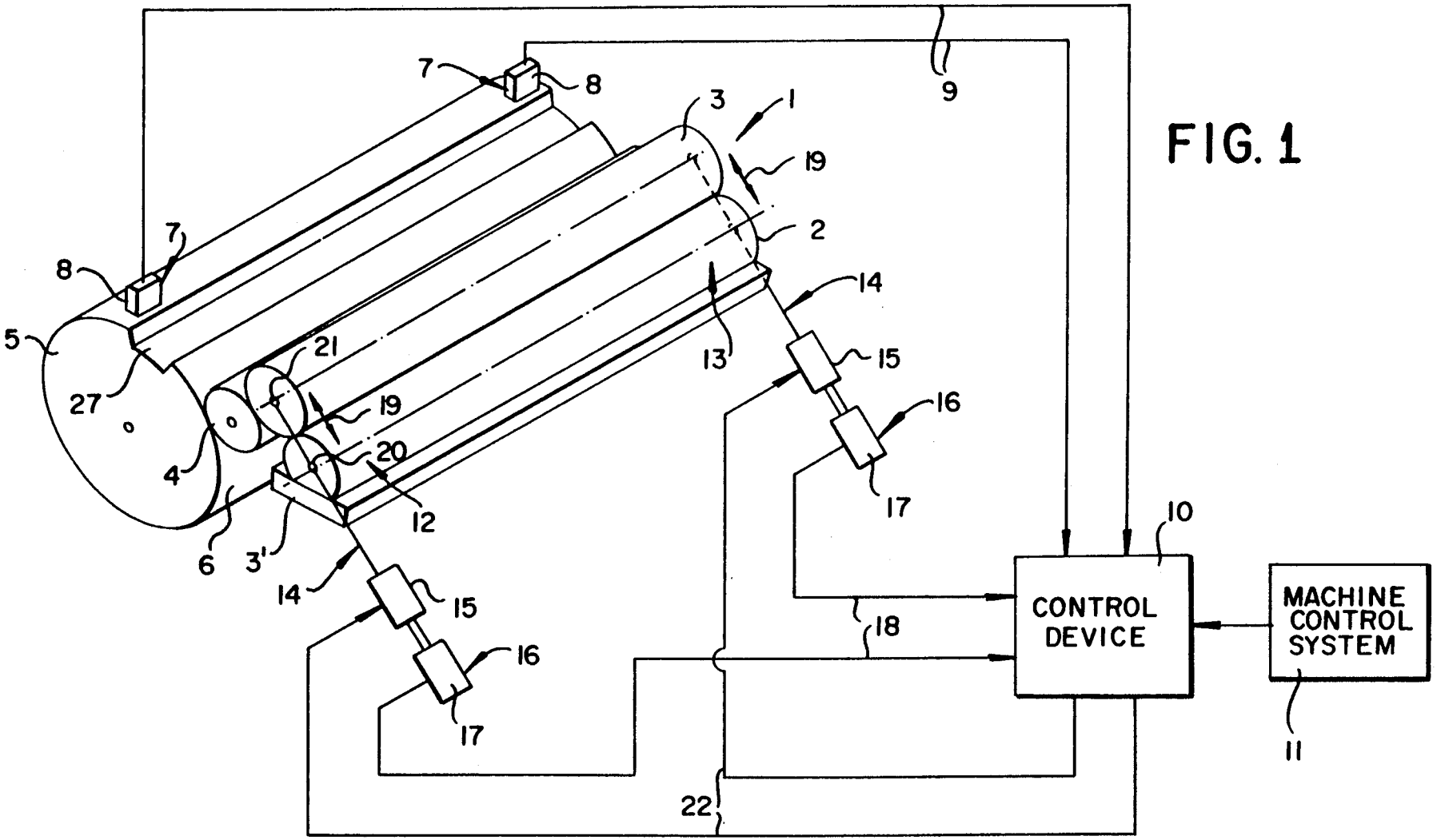
FIG. 1 is a diagrammatic and schematic view of a dampening unit of an offset printing machine with sensor and positioning devices.
Figure 4:
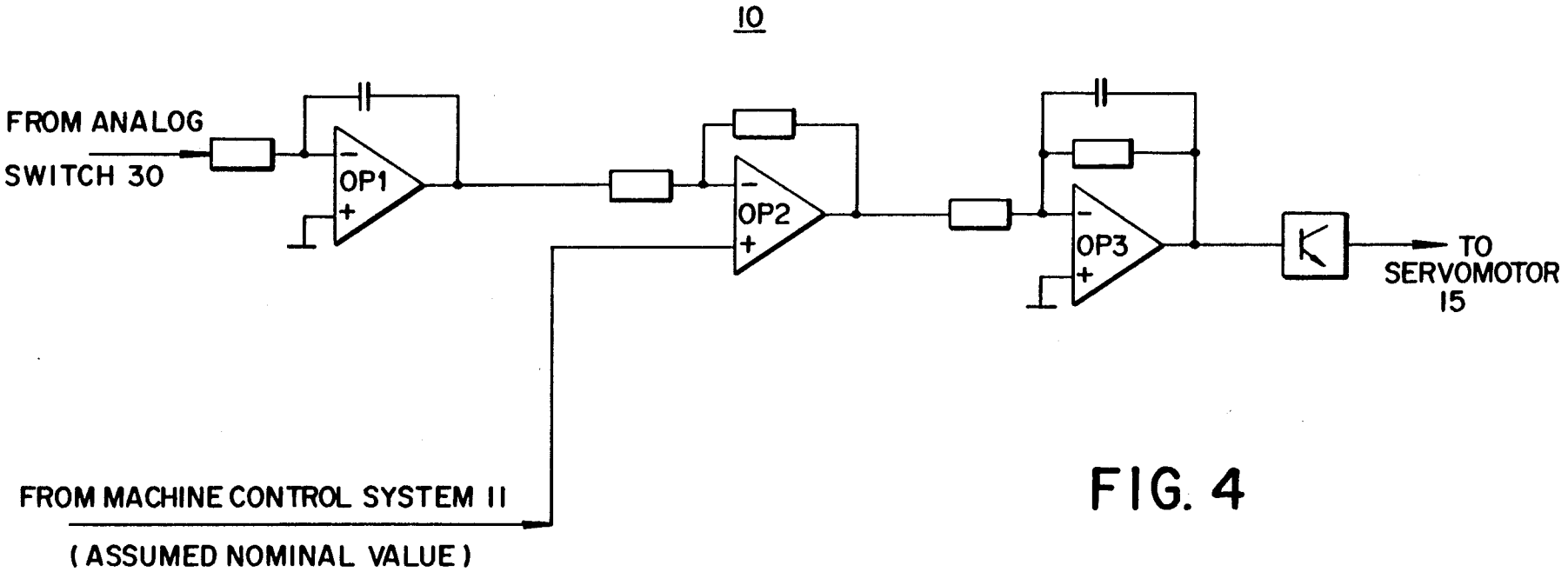
FIG. 4 is a partial circuit diagram of a control device for the device according to the invention.

Referring now to the drawing and, first, particularly to FIG. 1 thereof, there is shown therein a dampening unit 1 of an offset printing machine represented only by a plate cylinder 5 thereof. The dampening unit 1 has a dipping or immersion roller 2, also known as a water pan roller, a peripheral surface area of which dips into a vessel 3', containing dampening medium. The immersion roller 2 cooperates with a metering roller 3 which, in turn, engages a dampening-medium applicator roller 4 cooperating with a plate cylinder 5 which has an offset printing plate 6 (not represented in great detail) clamped to the outer cylindrical surface thereof. The outer cylindrical surface, in turn, of the offset printing plate 6 is scanned by an optical sensor device 7, which is formed of two sensors 8 disposed at a spaced distance from one another extending in the direction of the width of the printing format. The sensors 8 may be of the type of reflection light sensors made by the firm VISOLUX and catalogued as RL 4-Analog. The sensors 8 are arranged so that they lie somewhat in the region of longitudinal margins of the printing plate 6 located at both sides of the printed subject area. The sensors 8 are connected via leads 9 with a control device 10, which may be constructed as a microprocessor, but may have at least a partial construction such as is shown in FIG. 4. The control device 10 is connected to the conventional control system 11 of the offset printing machine.

At each end region 12 and 13, respectively, of the immersion roller 2 and the metering roller 3, respectively, a diagrammatically represented positioning or adjusting device 14 is provided. Each positioning or adjusting device 14 has an electrical positioning or adjusting drive 15, which is connected to a positioning probe or feeler 16. Each positioning probe or feeler 16 is preferably constructed as a potentiometer 17.

The otherwise non-illustrated construction means of each positioning or adjusting device 14 permit the adjustment of the immersion roller 2 and the metering roller 3 towards and away from one another, respectively, in the direction of the respective double-headed arrow 19. Accordingly, the rollers 2 and 3 can be set at an inclination relative to one another, with a variation in application or contact pressure therebetween, the axes 20 and 21, respectively, thereof remaining nevertheless in one plane. Control of the positioning or adjusting drives 15 is effected via leads 22 connected to the control device 10.

The device according to the invention is constructed so that, in relation to the data recorded by the sensors 8, the control device 10 triggers the positioning or adjusting drives 15 so that an optimal quantity of dampening medium which is required for the respective print, that optical quantity being dependent upon the printed subject area, is transferred to the surface of the offset printing plate 6 by an appropriate pressing of the immersion roller 2 and the metering roller 3 together. For this purpose, a parallel displacement of the axes 20 and 21, and/or also the aforedescribed inclined positioning of the aforementioned axes 20 and 21 can occur. By inclined positioning there is meant that a greater contact pressure is applied at one side region of the rollers than at the other side region. The potentiometers 17 report the respective position of the positioning or adjusting drives 15.

A detailed method of operating the device according to FIG. 1 is described hereinafter:

By means of the invention of the instant application, an optimal feeding of dampening medium adequate to the area of the printed subject and to the inking or ink feed should occur, the values for the dampening-medium feed having been established before the start of the actual printing process. For this purpose, inking of the printing plate 6 is effected by an otherwise non-illustrated inking unit. In this inking process, surfaces, which are normally ink-free in the production run process, acquire or receive ink. In the language of specialists in the art, this inking process is called "tinting" or "emulsifying". Due to the reception of ink by areas which are normally ink-free, a so-called "filling" or "crowding" of the printing plate 6 occurs. This process can occur without any dampening-medium feed at all or with a relatively slight feed of such dampening medium.

In accordance with the method of the invention, after the offset printing plate 6 has been "filled", a defined dampening-medium feed or an increase in the feed of dampening medium to a defined value, is performed so that a reduction of ink occurs in the "tinted" areas. The occurrence of this ink taking or reduction is detected by the sensors 8. The data thus obtained are processed in the control device 10, and represent a measurement or criterion for the feed of dampening medium to be adjusted. The manner and nature of the ink taking, which is also described as the "free-running" of the printing plate 6, and also the time required therefor and the corresponding number of revolutions of the plate cylinder 5 necessary therefor, respectively, form a measurement or criterion for the dampening-medium feed to be adjusted. The adjustment of the quantity of dampening medium occurs by adjusting the contact pressure between the dipping or duct roller 2 and the metering roller 3, especially when the axes 20 and 21 of these rollers 2 and 3 are also disposed at an inclination to one another. In this regard, the control device 10 controls the positioning or adjusting drives 15 via the leads 22 in an appropriate manner. A suitable positioning or adjustment message is transmitted via the potentiometers 17 and the leads 18.

Figure 2:
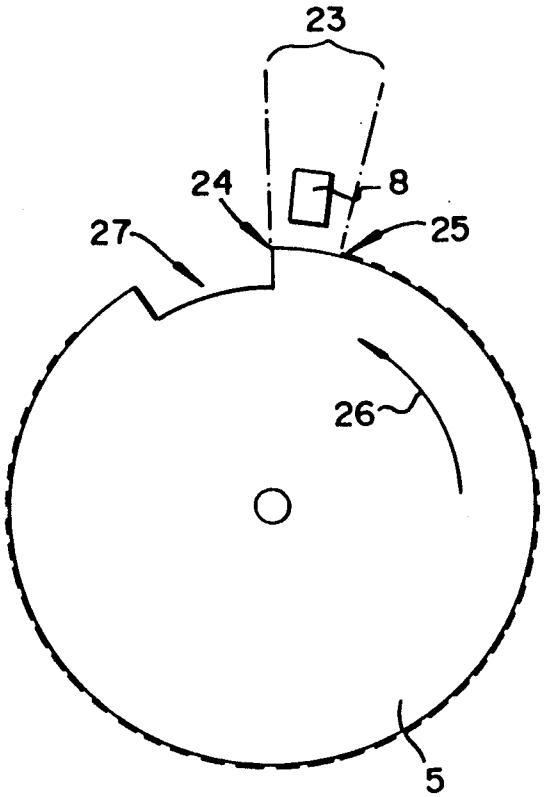
FIG. 2 is a diagrammatic end view of a plate cylinder forming part of the arrangement according to FIG. 1.

In accordance with the invention, during the performance of the method, monitoring or control of the outer cylindrical surface area of the offset printing plate 6 takes place in a peripheral zone 23 (FIG. 2), which includes the area between the starting end of the plate 24 and the starting end of the printed-subject area 25, represented by a broken line. In other words, the optical sensing by the sensors 8 occurs following i.e. immediately after, the longitudinal groove or channel 27 conventionally formed in the plate cylinder 5, which is provided to aid in fastening the printing plate, taking into account the direction of rotation of the plate cylinder 5, which is represented in FIG. 2 by an arrow 26. Based upon experience, the area from the start of the plate cylinder 5 to the start of the printed subject area 25 is highly subject to change, because smearing or the like is recognizable thereat at the earliest opportunity. Consequently, the changes resulting from the ink taking or reduction process do in fact occur early-on in this area.

The foregoing is clarified in accordance with an example: It is assumed that the printed subject area of the printing plate 6 which is used requires a non-uniform distribution of ink, e.g. one half requires considerably more ink than the other. If a uniform film of dampening medium is then fed over the width of the printing format, an excess of dampening medium will accumulate on the side which requires less dampening medium, without any use of the method according to the invention.

In accordance with the invention, however, the previously recognized trend towards an excess of dampening medium will lead to a more rapid free-running of the offset printing plate 6 on the appropriate side, which is detected by the appertaining sensor 8. This results in a suitable differential signal at both sensors 8, due to which the dipping or immersion roller 2 and the metering roller 3 become positioned at an inclination to one another through the action of the positioning or adjusting devices 14 so that symmetrical free-running of the offset printing plate 6 occurs. This leads to an adjustment of the rollers, which is dependent upon the printed subject area and, consequently, on the consumption, over the entire width, so that the dampening-medium feed is optimally determined.

Figure 3:
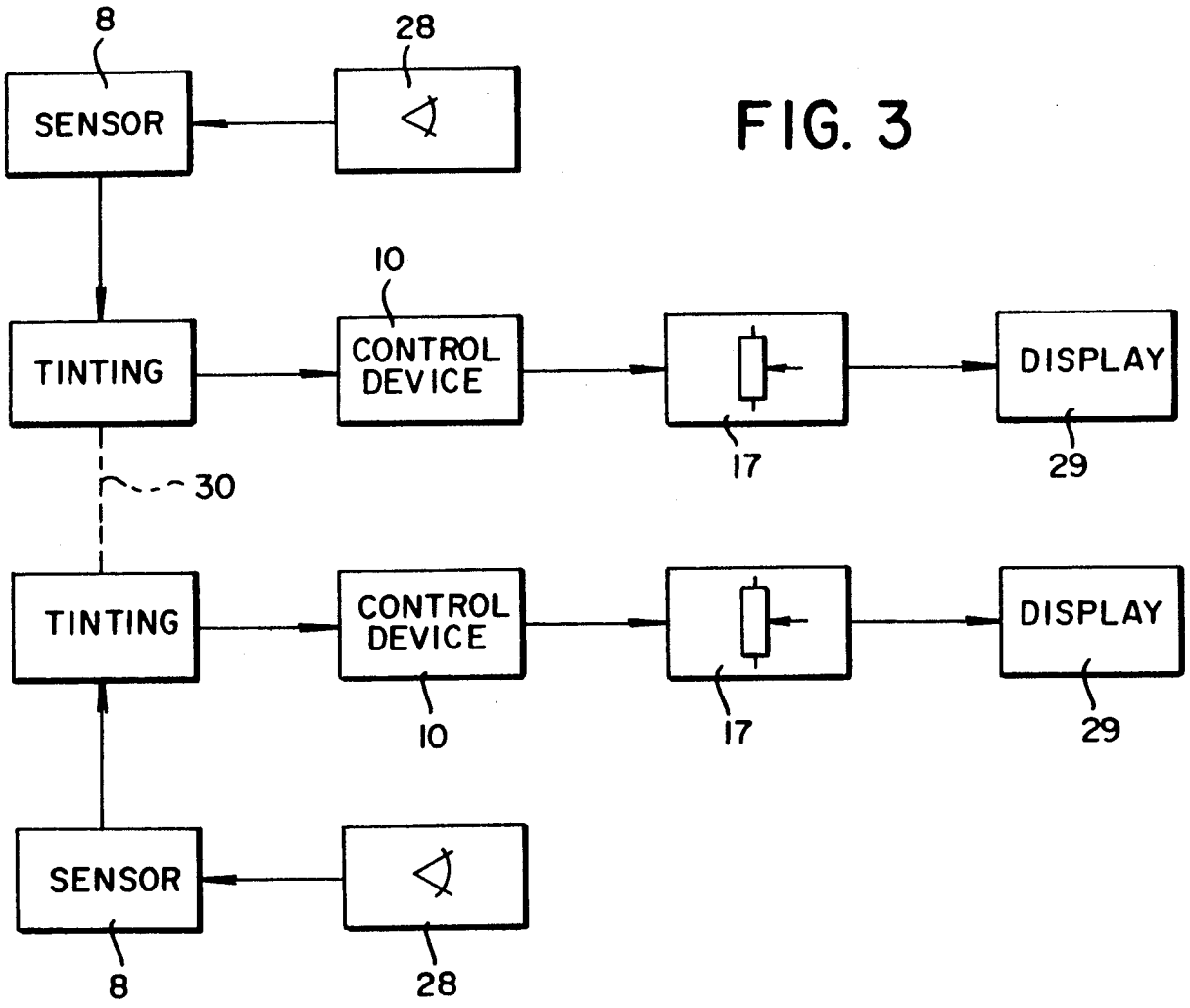
FIG. 3 is a general block diagram of the device according to the invention.

The functional operating sequence is again explained in accordance with the block diagram of FIG. 3; a rotational-angle transmitter 28 assigned to the plate cylinder 5 cooperates with a sensor 8 so that an interrogation of the surface of the offset printing plate 6 in the aforedescribed area 23 occurs. The sensor 8 monitors printing-plate areas which are normally ink-free with respect to a reception of ink (tinting). If a tinting process occurs, then the appertaining positioning or adjusting drive 15 is triggered by the control device 10 so that an increase in the dampening-medium feed occurs in the section assigned to the sensor 8 due to the change in the contact force between the immersion roller 2 and the metering roller 3 and the change in the relative setting of the inclination of these rollers to one another, respectively. The respective adjusted drive position is determined by the potentiometer 17 and can be indicated on a display 29.

Because a positioning or adjusting device 14 is assigned to each end area 12 and 13, respectively, of the dipping or immersion roller 2 and the metering roller 3, respectively, the individual components, respectively, are present in duplicate, i.e. two of each are present, in FIG. 3.

In accordance with another mode, the method according to the invention for determining dampening-medium feed on an offset printing machine can also be performed so that, initially, a preferably small quantity of dampening medium is applied to the printing plate and, subsequently, inking or ink feeding dependent upon the printed-subject area occurs over the width of the printing format in a manner that areas which are normally ink-free during the production-run process receive ink. The tinting process thus adjusting itself is detected by the sensors 8 and used as a measurement or criterion for the dampening-medium feed which is to be corrected. Therefore, the manner and nature of the filling of the offset printing plate 6 with ink forms the information for the dampening-medium feed to be undertaken.

A further mode of the method according to the invention includes initially applying a quantity of dampening medium to the printing plate 6, followed by feeding ink dependent upon a printed-subject area over the width of the printing format, and then reducing the quantity of dampening medium so that a tinting process results. This tinting process is, in turn, detected by the sensors and serves as a measurement or criterion for the quantity of dampening medium to be adjusted.

The application of the method and the device, respectively, according to the invention, is not restricted to the period of time before the actual printing process, but can also be implemented while the printing process is being performed, for the purpose of monitoring and correcting the feed of dampening medium. In addition, it is possible, in this regard, to use the sensors 8 for a double function, in that they optically measure the thickness of the layer of the dampening medium outside the monitoring area 23 and accordingly form an actual value for regulating or controlling the dampening medium.

Figure 3A:
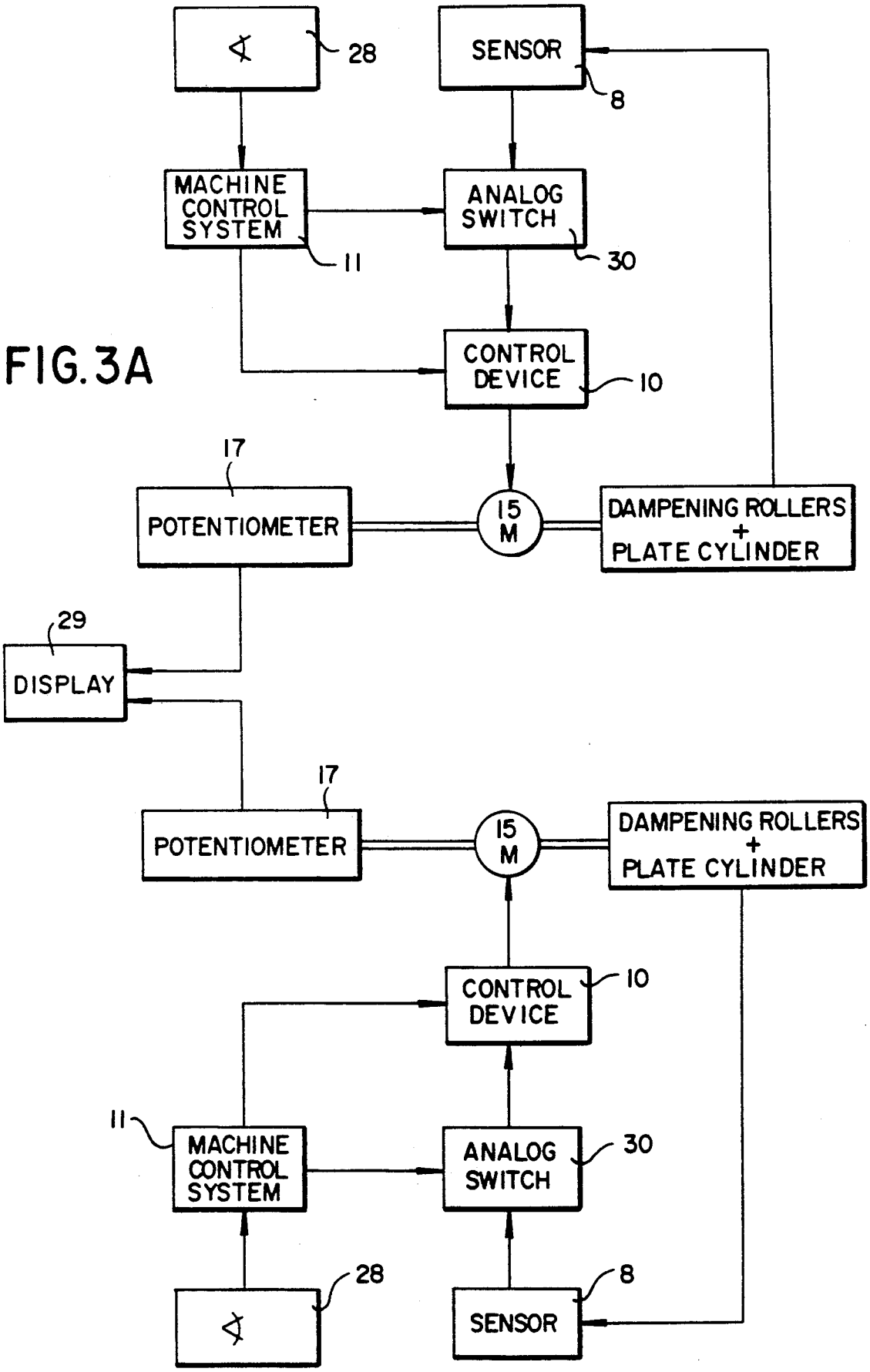
FIG. 3A is a more detailed block diagram of the device.

As shown in the more detailed block diagram of FIG. 3A, an intensity signal transmitted by the optical sensor 8 is fed via an analog switch 30 of the types made by Texas Instruments and catalogued as TL604C and TL604M, which is actuated by the conventional control system 11 of the printing machine in dependence upon the rotational-angle transmitter 28.

To determine the dampening-medium feed, the peripheral zone 23 of the printing plate 24 shown in FIG. 2 is scanned or sensed by the sensor 8, and the signals therefrom are transmitted via the analog switch 30 to the control device 10 which includes the circuit of FIG. 4. Thus, the signals are fed to an integrator OP1 and a control deviation is determined in OP2 and fed to a PI regulator OP3 from which, in turn, it is fed via a transistor power stage to the adjusting or servo-motor 15.

The assumed nominal value can be introduced by the printer manually or by the control system 11 of the printing machine. As is readily apparent from FIG. 3A, the device according to the invention is constructed symmetrically for both servomotors 15 which serve as the positioning or adjusting drives.

We claim:

1. Method of adjusting dampening-medium feed in an offset printing machine, which comprising inking a printing plate having a given width of the printing plate and a given image area of the printing machine, tinting of areas of the printing plate normally ink-free during a production-run, and feeding a defined quantity of dampening medium and increasing the dampening-medium feed, detecting ink taking from the tinted areas, and applying the ink taking as a measurement for the dampening-medium feed.

2. Method according to claim 1, which includes feeding the dampening medium in dependence upon the given image area, and over the given width of the given image area.

3. Method according to claim 1, which includes feeding the dampening medium in a manner that the tinted areas become ink-free to a substantially uniform extent over the given width of the printing plate and the width of the given image area, respectively.

4. Method according to claim 1, which includes detecting the ink taking by observation.

5. Method according to claim 1, which includes detecting the ink taking by means of optical sensors.

6. Method according to claim 5, which includes additionally determining the thickness of a layer of the dampening medium by the sensors.

7. Method according to claim 1, which includes monitoring the ink taking in an elongate peripheral zone of the printing plate which is clamped to a plate cylinder of the printing machine.

8. Method according to claim 1, which includes monitoring the ink taking periodically.

9. Method according to claim 8, where the periodic monitoring of the ink taking is with each revolution of a plate cylinder on which the printing plate is clamped.

10. Method according to claim 1, comprising at least one of the steps of adjusting the rotational speed of a dipping roller of a dampening unit, adjusting contact pressure between the dipping roller and a metering roller of the dampening unit, and adjusting a relative inclination of the immersion roller and the metering roller to one another for adjusting the quantity of dampening medium feed.

11. Method according to claim 1, wherein the tinting process includes gradually applying a defined quantity of ink distributed over the width of the printing plate and the width of the given image area, respectively.

12. Method according to claim 1, comprising the steps of observing at least one of the type and time of the ink taking, and using the steps of observing said type and time of ink taking as a measurement for the dampening-medium feed.

13. Method of determining dampening-medium feed in an offset printing machine, wherein a quantity of dampening medium is applied to a printing plate, the method which comprises feeding ink over the width of a printing plate in dependence upon a printed image area of the printing plate so that areas which are normally ink-free in a production-run process performed in the printing machine receive ink as tinting, detecting the tinting, and applying dampening-medium feed as a means of adjusting dampening medium supply.

14. Method of determining the quantity of dampening-medium feed in an offset printing machine, wherein the quantity of dampening medium is applied to a printing plate having an image area, which comprises feeding ink in dependence upon the image area of the printing plate over the width of the printing plate, thereafter, reducing the quantity of dampening medium so that image areas normally ink-free in a production-run receive an amount of ink as tinting, detecting the amount of tinting, and applying the detected amount as a means, for adjustment of the dampening-medium feed.

15. Device for determining dampening-medium feed in an offset printing machine, comprising a sensor device for optically scanning a surface area, a printing plate having a surface area scanned by the sensor device, a plate cylinder for clampingly supporting the printing plate, the sensor device operative for transmitting an output signal indicating the degree of tinting of said surface area, a roller assembly of a dampening unit including a dipping roller and a metering roller cooperatively in contact with one another and having coplanar axes, for applying dampening medium to said printing plate, said sensor device comprising at least two sensors disposed at a spaced distance from another in a direction of the width of the printing plate for monitoring tinting of areas of the printing plate normally ink-free in a production-run, and a positioning device coupled to said sensor device for adjusting said axes of said dipping roller and said metering roller from the coplanar position to a position wherein said axes are mutually inclined to a degree commensurate with said degree of tinting of said surface area.

16. Device according to claim 15, wherein said positioning device has an electrical adjusting drive, respectively, at each end region of said immersion and metering rollers, each of said adjusting drives having an adjusting probe connected to an electrical control device, said control device having means for triggering the appertaining adjusting drive, said sensors being connected to said control device.

17. Device according to claim 15, wherein said sensors are disposed so as to monitor an area between a starting location of said printing plate and a starting location of said printed-subject area.

18. Device according to claim 15 including a plurality of optical sensors in said sensor device for monitoring ink densities along said printing plate.

19. Device according to claim 18, wherein said plurality of optical sensors are spaced equidistantly from one another.

20. Method of operating a device for determining dampening-medium feed in an offset printing machine having an inking unit and an ink-sensing device for optically scanning a surface of a printing plate and for transmitting an output signal influencing a quantity of dampening medium being fed to a dampening roller assembly of a dampening unit coupled to the ink-sensing device, which comprises tinting areas of the printing plate with ink normally ink-free in a production-run process, and subsequently feeding dampening-medium with the roller assembly in response to the ink-sensing device until detecting ink taking from the tinted areas.

21. Method of operating a device for determining dampening-medium feed in an offset printing machine having a printing plate, a sensor device for optically scanning the printing plate, an inking unit for inking the printing plate, and a dampening unit for applying dampening medium to the printing plate coupled to said sensor device, which comprises inking with the inking unit the printing plate, with respect to a printed-subject area, over the width of a printing format, controlling the ink density so that areas of the printing plate normally ink-free in a production-run process are tinted, detecting the tinting with the sensor device and controlling dampening-medium feed with the dampening unit in response to said sensor device.

22. Method of operating a device for determining dampening-medium feed in an offset printing machine having a printing plate, a sensor device for optically scanning the printing plate, an inking unit for inking the printing plate coupled to said sensor device, and a dampening unit for applying dampening medium to the printing plate, which comprises inking over the width of a printed image on a printing plate with the inking unit, reducing the quantity of dampening medium with a dampening medium control device of the dampening unit so that areas normally ink-free receive ink as tinting, detecting the tinting with the sensor device, and adjusting the feed of dampening medium with the dampening unit in response to said sensor device.

* * * * *